US007563221B2

(12) United States Patent
Polloni et al.

(10) Patent No.: US 7,563,221 B2
(45) Date of Patent: Jul. 21, 2009

(54) CIGARETTE PACKING MACHINE

(75) Inventors: Roberto Polloni, Modigliana (IT); Marco Ghini, Monte San Pietro (IT); Michele Squarzoni, Ferrara (IT); Stefano Serafini, Crevalcore (IT); Roberto Osti, Zola Predosa (IT); Marco Brizzi, Zola Predosa (IT)

(73) Assignee: G.D Societa' per Azioni (IT)

( * ) Notice: Subject to any disclaimer, the term of this patent is extended or adjusted under 35 U.S.C. 154(b) by 57 days.

(21) Appl. No.: 10/598,771

(22) PCT Filed: Mar. 10, 2005

(86) PCT No.: PCT/EP2005/051097

§ 371 (c)(1),
(2), (4) Date: May 16, 2007

(87) PCT Pub. No.: WO2005/087595

PCT Pub. Date: Sep. 22, 2005

(65) Prior Publication Data

US 2008/0016822 A1 Jan. 24, 2008

(30) Foreign Application Priority Data

Mar. 11, 2004 (IT) ..... BO2004A0135
Oct. 11, 2004 (IT) ..... BO2004A0618
Feb. 2, 2005 (IT) ..... BO2005A0052

(51) Int. Cl.
*B65B 11/28* (2006.01)
*B65B 19/04* (2006.01)

(52) U.S. Cl. ..... 531/234; 53/148; 53/444; 53/461

(58) Field of Classification Search ..... 53/148, 53/158, 228, 232, 233, 234, 456, 461, 444
See application file for complete search history.

(56) References Cited

U.S. PATENT DOCUMENTS 3,948,115 A * 4/1976 Seragnoli ..... 74/421 R
3,956,865 A * 5/1976 Schmermund ..... 53/456
4,095,396 A * 6/1978 Seragnoli ..... 53/234
4,144,695 A 3/1979 Seragnoli et al.
4,150,520 A * 4/1979 Palmieri et al. ..... 53/225
4,265,073 A * 5/1981 Seragnoli ..... 53/542
4,559,757 A * 12/1985 Focke et al. ..... 53/176
4,559,758 A * 12/1985 Gamberini ..... 53/207
4,887,408 A * 12/1989 Mattei et al. ..... 53/412

(Continued)

FOREIGN PATENT DOCUMENTS

EP 0 873 939 A 10/1998

OTHER PUBLICATIONS

International Search Report PCT/EP2005/051097 dated May 20, 2005 (European Patent Office, The Netherlands).

*Primary Examiner*—Paul R Durand
(74) *Attorney, Agent, or Firm*—Ostrolenk, Faber, LLP

(57) ABSTRACT

A multipurpose packing machine having an input portion and an output portion, and wherein the input portion has a first packing module for forming a succession of rigid first packages about respective packed groups of cigarettes, to produce a succession of first packets; and the output portion has at least a further packing module similar to the first packing module and for forming a succession of rigid further packages, each housing at least one respective first packet.

21 Claims, 10 Drawing Sheets

U.S. PATENT DOCUMENTS 4,938,656 A 7/1990 Gamberini et al.
4,947,617 A * 8/1990 Focke et al. ..... 53/234
5,038,546 A * 8/1991 Oberdorf ..... 53/202
5,163,268 A * 11/1992 Vaccari et al. ..... 53/397
5,216,869 A * 6/1993 Boldrini et al. ..... 53/387.3
5,588,281 A * 12/1996 Boriani et al. ..... 53/443
5,755,080 A * 5/1998 Draghetti et al. ..... 53/466
6,748,719 B2 * 6/2004 Salicini et al. ..... 53/171
6,854,243 B2 * 2/2005 Sendo et al. ..... 53/234
7,107,737 B2 * 9/2006 Spatafora ..... 53/234
7,155,882 B2 * 1/2007 Ghini et al. ..... 53/444

* cited by examiner

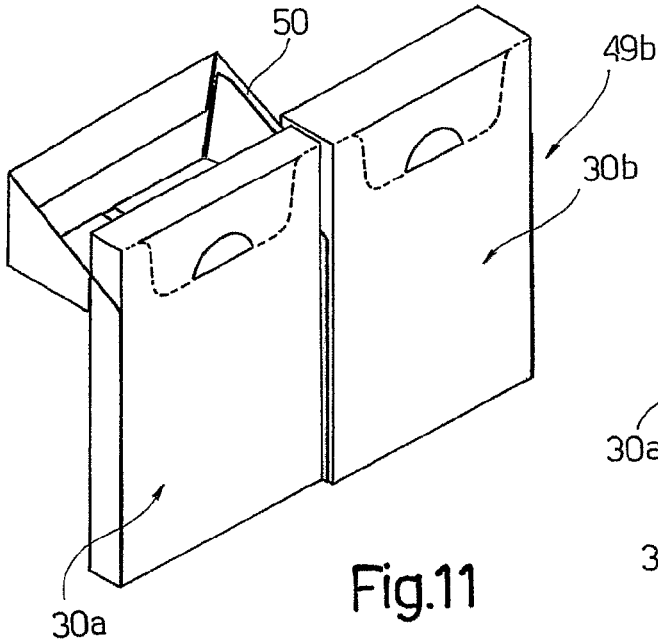
Fig.11
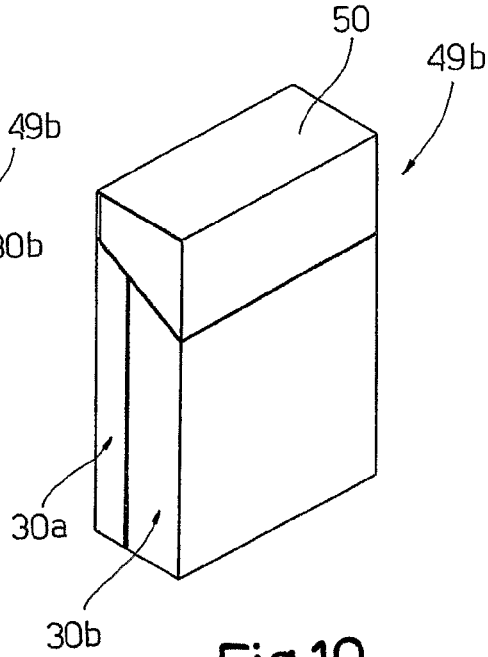
Fig.10
Fig.9
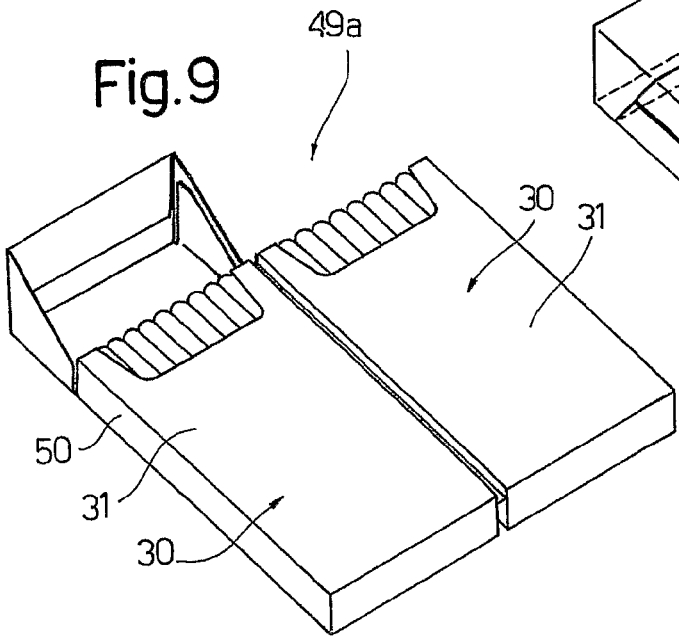
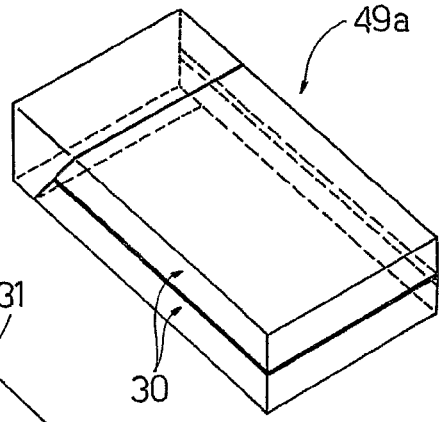
Fig.8

CIGARETTE PACKING MACHINE

CROSS REFERENCE TO RELATED APPLICATION

The present application is a 35 U.S.C. §§ 371 national phase conversion of PCT/EP2005/051097, filed 10 Mar. 2005, which claims priority of Italian Patent Application No. BO2004A 000135, filed 11 Mar. 2004, Italian Patent Application No. BO2004A 000618, filed 11 Oct. 2004, and Italian Patent Application No. BO2005A 000052, filed 2 Feb. 2005, which is herein incorporated by reference. The PCT International Application was published in the English language.

TECHNICAL FIELD

The present invention relates to a multipurpose packing machine.

Though suitable for packing any type of product, in particular a substantially parallelepiped-shaped product, the present invention may be used to particular advantage in the tobacco industry for producing rigid packets of cigarettes, to which the following description refers purely by way of example.

BACKGROUND ART

In the tobacco industry, various types of rigid packets are produced, for example: packets having a rigid outer package formed by folding a first blank (dispensable) normally defined by a collar of cardboard or similar, and by folding a second blank also made of cardboard or similar and defining an outer package; or packets whose outer package is defined by a first rigid package formed by folding a relative blank of cardboard or similar with or without a respective collar, and by a second rigid package formed by folding a relative blank of cardboard or similar, and housing the first package, which is at least partly removable; or packets, in which a rigid outer package—normally, though not necessarily, opened wallet-fashion and formed by folding a relative blank of cardboard or similar—houses a number of identical or different groups of cigarettes, each having a relative rigid package with or without a relative collar, or houses one or more groups of cigarettes, each of which has a relative rigid package with or without a relative collar, and is associated with one or more objects of a different nature.

Normally, each of the above types of packet is produced on a specially designed packing machine.

DISCLOSURE OF INVENTION

It is an object of the present invention to provide a multipurpose packing machine, the layout of which is such as to enable production of any of the types of packet referred to above by way of example, by changing or possibly repositioning certain members, such as packing wheels or, more simply, folding devices, gumming devices, and similar.

According to the present invention, there is provided a packing machine as claimed in Claim 1 or in any one of the following Claims depending directly or indirectly on Claim 1.

BRIEF DESCRIPTION OF THE DRAWINGS

A number of non-limiting embodiments of the present invention will be described by way of example with reference to the accompanying drawings, in which:

FIGS. 8 and 9 show, in perspective and in a closed and open position respectively, a first type of packet that can be produced on the FIG. 1 packing machine;

FIGS. 10 and 11 show views in perspective of a variation of the FIGS. 8 and 9 packet in a closed and open position respectively;

BEST MODE FOR CARRYING OUT THE INVENTION

Figure 1:
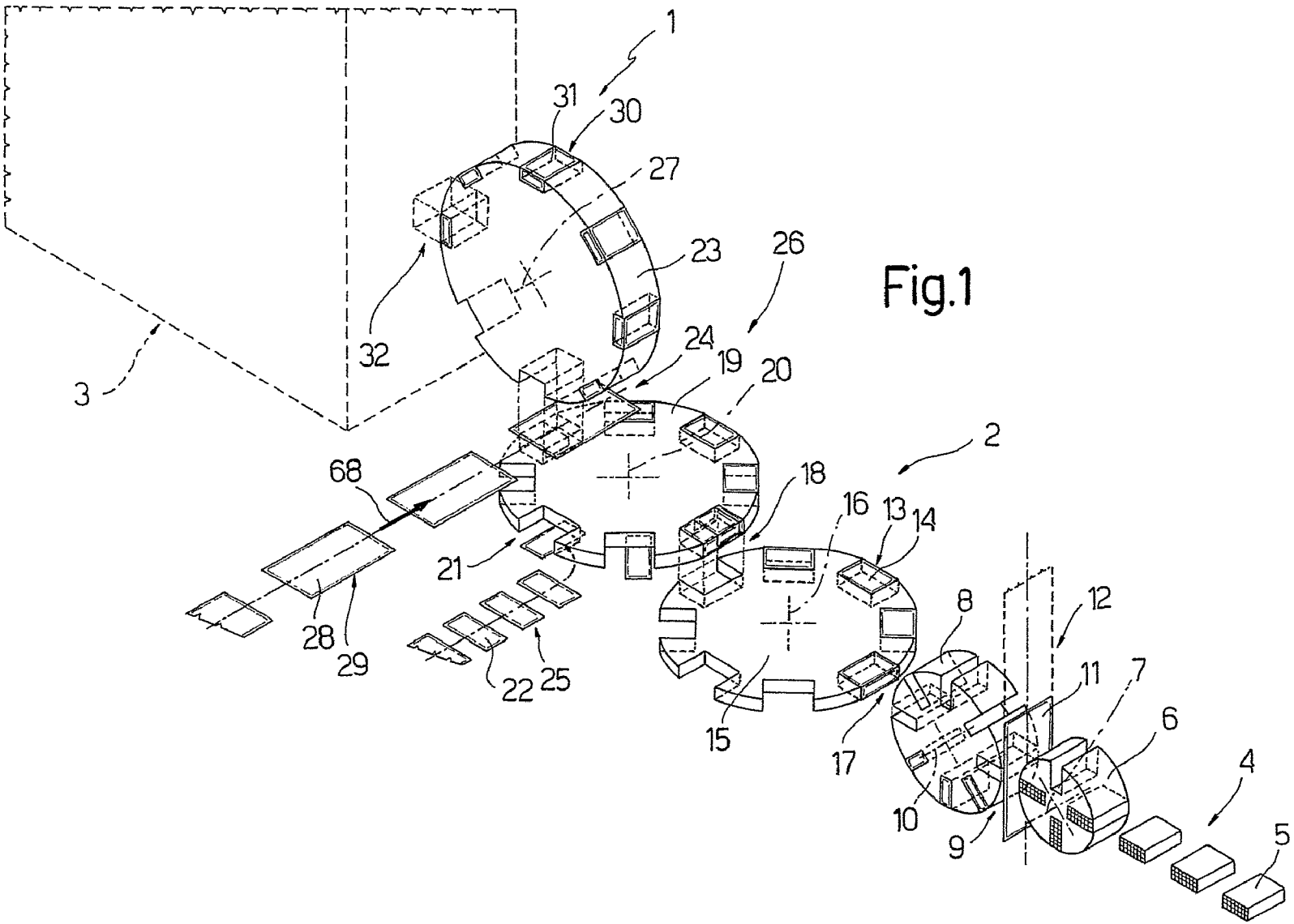
FIG. 1 shows a schematic view in perspective, partly in block form and with parts removed for clarity, of a preferred embodiment of a packing machine in accordance with the present invention.

Number 1 in FIG. 1 indicates as a whole a cigarette packing machine comprising an input portion 2 and an output portion 3.

Input portion 2 is substantially defined by a standard packing machine for producing rigid packets and comprising a known line 4 (shown only partly) for forming groups 5 of cigarettes; and a known first wheel 6, which rotates in steps about a horizontal axis 7 to receive successive groups 5 and transfer groups 5 to a second wheel 8 at a transfer station 9. The second wheel 8 is a packing wheel mounted to rotate in steps about an axis 10 parallel to axis 7, and which receives each group 5 successively in known manner, together with a relative sheet of packing material 11, normally a sheet of foil packing material, fed in known manner to transfer station 9 by a feed line 12, and folds each sheet of packing material 11 in known manner about relative group 5 to form a relative packed group 13, in which relative group 5 has a so-called inner package 14.

Input portion 2 also comprises, in known manner, a third wheel 15, which is a transfer wheel rotating in steps about a substantially vertical axis 16 crosswise to axis 7, and which receives packed groups 13 successively in known manner from second wheel 8 at a transfer station 17, and feeds packed groups 13, at a transfer station 18, to a known fourth wheel 19 structurally identical to third wheel 15 and rotating in steps about an axis 20 parallel to axis 16. On the periphery of both third wheel 15 and fourth wheel 19, each packed group 13, which is substantially in the form of a rectangular parallelepiped, is positioned on edge, i.e. with a minor lateral surface facing outwards, and with its longitudinal axis (always parallel to the axes of the relative cigarettes) crosswise to axis 16, 20 and substantially tangent to the periphery of relative wheel 15, 19. Fourth wheel 19 and third wheel 15 overlap at transfer station 18, and packed groups 13 are transferred from third wheel 15 to fourth wheel 19 by a movement parallel to axes 16 and 20.

Fourth wheel 19 is a packing wheel, which, in known manner at an input station 21 upstream from transfer station 18, is fed successively with blanks 22, normally cardboard blanks with preformed fold lines, each of which is folded about a relative packed group 13, and then transferred, together with relative packed group 13, to a fifth wheel 23 at a transfer station 24.

Blanks 22 are fed to input station 21 by a known feed line 25, which in some cases may be left idle or even dispensed with.

Fifth wheel 23 is an output wheel (23; 39) of a packing module 26 (of which fourth wheel 19 defines an input wheel (19; 38)), and is a packing wheel mounted to rotate in steps about an axis 27 parallel to axis 7, and which, in known manner, receives each packed group 13 and relative blank 22 (if any) together with a relative further blank 28 fed in known manner to transfer station 24 by a feed line 29. Fifth wheel 23 folds each blank 28 in known manner about relative packed group 13 to form a relative packet 30, the relative packed group 13 of which is housed inside a package 31 defined by relative blank 28 and relative blank 22 (if any).

In a variation not shown, feed line 12 is idle, so that fifth wheel 23 is fed with a succession of bare groups 5, i.e. groups 5 with no inner package 14 and, normally, no blank 22; in which case, each blank 28 is folded by fifth wheel 23 directly about relative group 5.

If, for example, as is normally the case, blank 22 is a collar blank, and blank 28 is a standard hinged-lid blank, then relative packet 30 is a standard hinged-lid packet. Alternatively, packet 30 may be any packet whose package 31 is at least partly open or can be opened at one end, and is provided or not with a collar.

Packets 30 are fed successively by fifth wheel 23 to an input of output portion 3 at a transfer station 32. More specifically, each packet 30 reaching transfer station 32 is positioned flat on the periphery of fifth wheel 23, i.e. with a major lateral surface of relative packed group 13 facing outwards, and with the longitudinal axis of relative packed group 13 (parallel to the relative cigarettes) parallel to axis 27 of fifth wheel 23.

Figure 2:
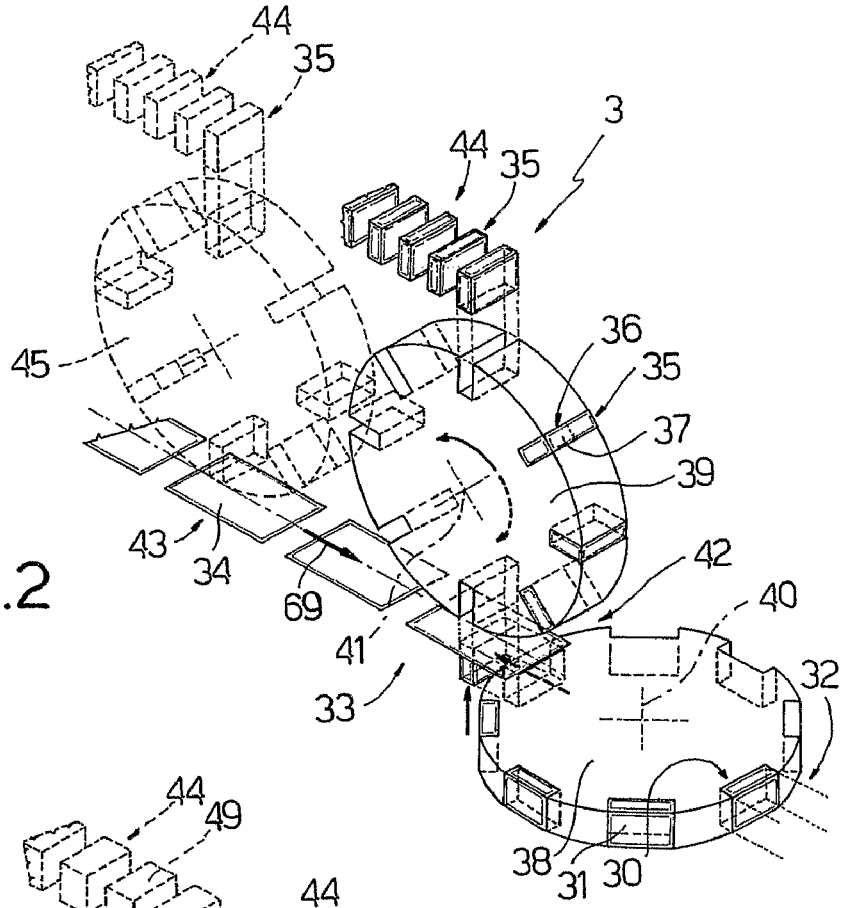
FIGS. 2 to 7 show schematic views in perspective of respective preferred embodiments of a detail in FIG. 1.

In the FIG. 2 embodiment, output portion 3 comprises a packing module 33 similar to packing module 26 and for packing each packet 30 by folding a respective further blank 34 about relative package 31 to form a packet 35 of the type having a double outer package 36 defined by package 31 and by a further package 37 made from relative blank 34 and from which packet 30 is at least partly removable. Alternatively, package 37 may be at least partly opened for at least partial access to relative packet 30.

Like packing module 26, packing module 33 comprises an input wheel 38 and an output wheel 39 similar to fourth wheel 19 and fifth wheel 23 respectively, and which rotate in steps about respective axes 40 and 41 crosswise to each other and parallel to axes 20 and 27 respectively.

Input wheel 38 is a transfer wheel for receiving packets 30 successively at transfer station 32, and for transferring packets 30 to output wheel 39 at a transfer station 42. On the periphery of input wheel 38, each packet 30 is positioned flat, i.e. with a major lateral surface of relative packed group 13 facing outwards, and with the longitudinal axis of relative packed group 13 (parallel to the relative cigarettes) crosswise to axis 40 and substantially tangent to the outer periphery of input wheel 38.

Output wheel 39 is a packing wheel for receiving each packet 30 at transfer station 42, together with relative blank 34, normally a cardboard blank with preformed fold lines, fed in known manner to transfer station 42 by a feed line 43. On the periphery of output wheel 39, each packet 30 is positioned on edge, i.e. with a minor lateral surface of relative packed group 13 facing outwards, and with the longitudinal axis of relative packed group 13 (parallel to the relative cigarettes) parallel to axis 41 of output wheel 39, which folds each blank 34 in known manner about relative packet 30 to form relative outer package 37, and successively transfers the packets 35 so formed to a known drying line 44 defining an output of packing machine 1.

If packets 35 arrive incorrectly oriented at the input of drying line 44 (e.g. with lateral tabs (not shown) facing in the insertion direction of packets 35 onto drying line 44), and/or if packets 35 have asymmetrical structures which, on leaving output wheel 39, must be positioned a given way, and/or if blanks 34 are too complicated to be folded in the space, along the periphery of output wheel 39, between transfer station 42 and the input of drying line 44, then packing module 33 comprises an additional wheel 45 parallel to output wheel 39 and interposed between output wheel 39 and drying line 44 to complete the folding of blanks 34, if necessary, and, in any case, to turn packets 35 over through 180° about their respective longitudinal axes parallel to axis 41 and to the axes of the cigarettes in relative packed groups 13 (FIG. 1).

Alternatively, the packets may be turned over through 180° by simply inverting the rotation direction of output wheel 39.

Figure 3:
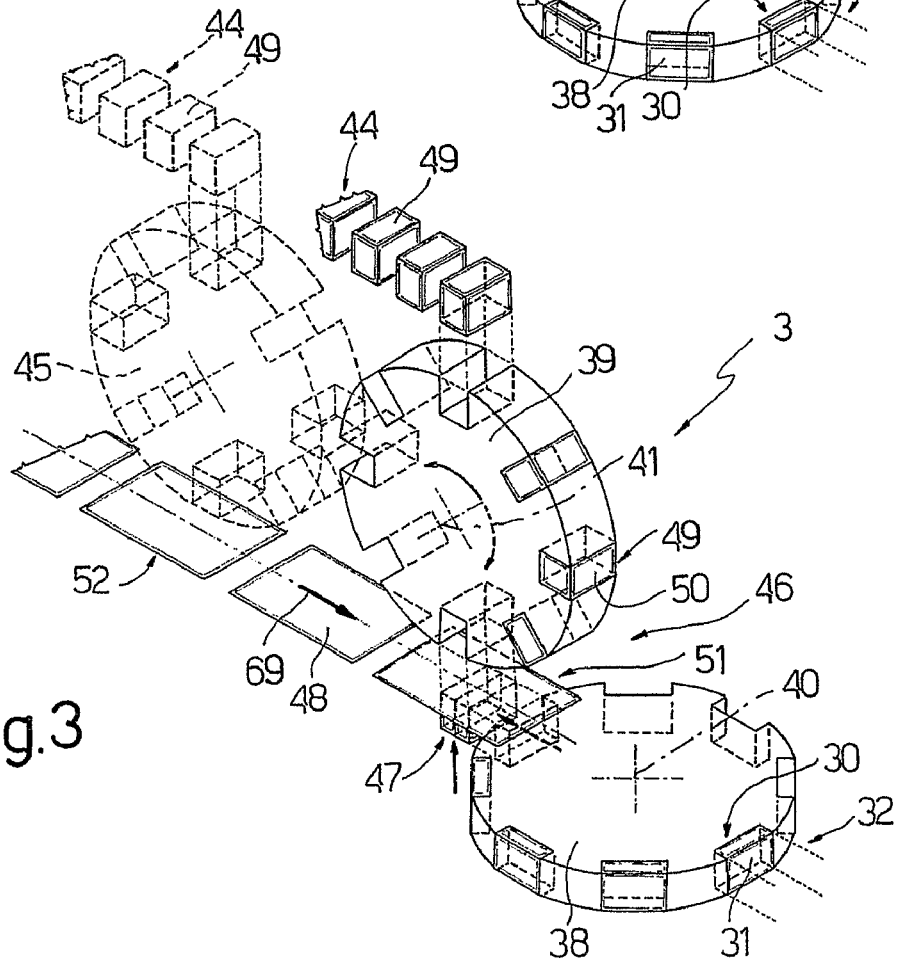

In the FIG. 3 embodiment, output portion 3 comprises a packing module 46 similar to packing module 26 and for forming packets 30 into groups 47 of two or more packets 30, and for packing each group 47 by folding a respective further blank 48 about group 47 to form a packet 49 of the type comprising a package 50, from which packets 30 of relative group 47 are at least partly removable or can be made at least partly accessible simultaneously or one at a time.

Like packing module 26, packing module 46 comprises an input wheel 38 and an output wheel 39 similar to fourth wheel 19 and fifth wheel 23 respectively, and rotating in steps about respective axes 40 and 41 crosswise to each other and parallel to axes 20 and 27 respectively. Unlike packing modules 26 and 33, however, whose wheels advance at the same rate, the advance rate of input wheel 38 of packing module 46 is a multiple, equal to the number of packets 30 in each group 47, of the advance rate of relative output wheel 39.

Input wheel 38 of packing module 46 is a transfer wheel for receiving packets 30 successively at transfer station 32, and for transferring packets 30 to relative output wheel 39 at a transfer station defined by an accumulating station 51. On the periphery of input wheel 38, each packet 30 is positioned flat, i.e. with a major lateral surface of relative packed group 13 facing outwards, and with the longitudinal axis of relative packed group 13 (parallel to the relative cigarettes) crosswise to axis 40 and substantially tangent to the outer periphery of input wheel 38.

At accumulating station 51, each packet 30 is unloaded radially in known manner off input wheel 38 and combined with one or more other packets 30 to form a relative group 47, which is then loaded in known manner onto output wheel 39.

In a variation not shown, each packet is unloaded axially in known manner off input wheel 38, so as to form, when combined with one or more other packets 30, a group 47 (not shown) of side by side packets 30.

Output wheel 39 of packing module 46 is a packing wheel for receiving each group 47 at accumulating station 51, together with relative blank 48, normally a cardboard blank with preformed fold lines, fed in known manner to accumulating station 51 by a feed line 52. On the periphery of output wheel 39, each group 47 is positioned on edge, i.e. with a minor lateral surface of each relative packed group 13 facing outwards, and with the longitudinal axis of each relative packed group 13 (parallel to the relative cigarettes) parallel to axis 41 of output wheel 39, which folds each blank 48 in known manner about relative group 47 to form relative package 50, and successively transfers the packets 49 so formed to a drying line 44 defining an output of packing machine 1.

As with packing module 33, if packets 49 arrive incorrectly oriented at the input of drying line 44 (e.g. with lateral tabs (not shown) facing in the insertion direction of packets 49 onto drying line 44), and/or if packets 49 have asymmetrical structures which, on leaving output wheel 39, must be positioned a given way, and/or if blanks 48 are too complicated to be folded in the space, along the periphery of output wheel 39, between accumulating station 51 and the input of drying line 44, then packing module 46 also comprises an additional wheel 45 parallel to output wheel 39 and interposed between output wheel 39 and drying line 44 to complete the folding of blanks 48, if necessary, and, in any case, to turn packets 49 over through 180° about their respective longitudinal axes parallel to axis 41 and to the axes of the cigarettes in relative packed groups 13 (FIG. 1).

Alternatively, in this case too, the packets may be turned over through 180° by simply inverting the rotation direction of output wheel 39.

Figure 4:
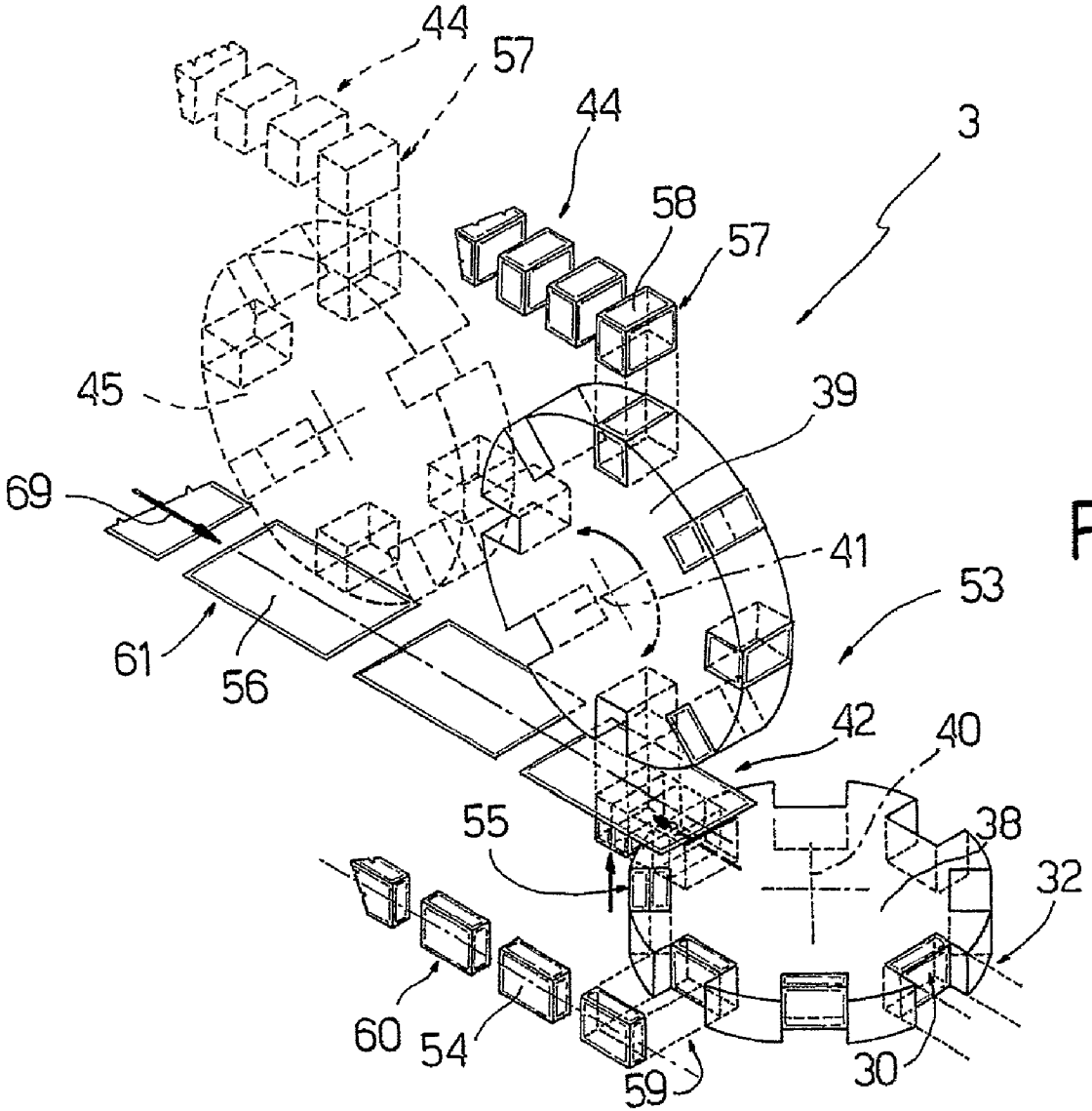

In the FIG. 4 embodiment, output portion 3 comprises a packing module 53 similar to packing module 26, conceptually identical to packing module 33, and for combining each packet 30 with an object 54—which may be another packet identical or similar to packet 30, or any other item of transverse dimensions compatible with those of packets 30—to form a succession of groups 55, and for packing each group 55 by folding a respective further blank 56 about group 55 to form a packet 57 of the type comprising a package 58, from which packet 30 and object 54 of relative group 55 are at least partly removable or can be made at least partly accessible.

Like packing module 33, packing module 53 comprises an input wheel 38 and an output wheel 39 similar to fourth wheel 19 and fifth wheel 23 respectively, and rotating in steps, at the same advance rate, about respective axes 40 and 41 crosswise to each other and parallel to axes 20 and 27 respectively.

Input wheel 38 of packing module 53 is a transfer wheel for receiving packets 30 successively at transfer station 32, and for feeding packets 30 to a transfer station 42 via a loading station 59, where each packet 30 is combined with a relative object 54 fed to loading station 59 by a feed line 60 to form, on input wheel 38, a relative group 55, which is then transferred to output wheel 39 at transfer station 42. On the periphery of input wheel 38, each group 55 is positioned flat, i.e. with a major lateral surface of each relative packed group 13 facing outwards, and with the longitudinal axis of each relative packed group 13 (parallel to the relative cigarettes) crosswise to axis 40 and substantially tangent to the outer periphery of input wheel 38.

Output wheel 39 of packing module 53 is a packing wheel for receiving each group 55 at transfer station 42, together with relative blank 56, normally a cardboard blank with preformed fold lines, fed in known manner to transfer station 42 by a feed line 61. On the periphery of output wheel 39, each group 55 is positioned on edge, i.e. with a minor lateral surface of each relative packed group 13 facing outwards, and with the longitudinal axis of each relative packed group 13 (parallel to the relative cigarettes) parallel to axis 41 of output wheel 39, which folds each blank 56 in known manner about relative group 55 to form relative outer package 58, and successively transfers the packets 57 so formed to a drying line 44 defining an output of packing machine 1.

As with packing module 33, if packets 57 arrive incorrectly oriented at the input of drying line 44 (e.g. with lateral tabs (not shown) facing in the insertion direction of packets 57 onto drying line 44), and/or if packets 57 have asymmetrical structures which, on leaving output wheel 39, must be positioned a given way, and/or if blanks 56 are too complicated to be folded in the space, along the periphery of output wheel 39, between transfer station 42 and the input of drying line 44, then packing module 53 also comprises an additional wheel 45 parallel to output wheel 39 and interposed between output wheel 39 and drying line 44 to complete the folding of blanks 56, if necessary, and, in any case, to turn packets 57 over through 180° about their respective longitudinal axes parallel to axis 41.

Alternatively, in this case too, the packets may be turned over through 180° by simply inverting the rotation direction of output wheel 39.

Figure 5A:
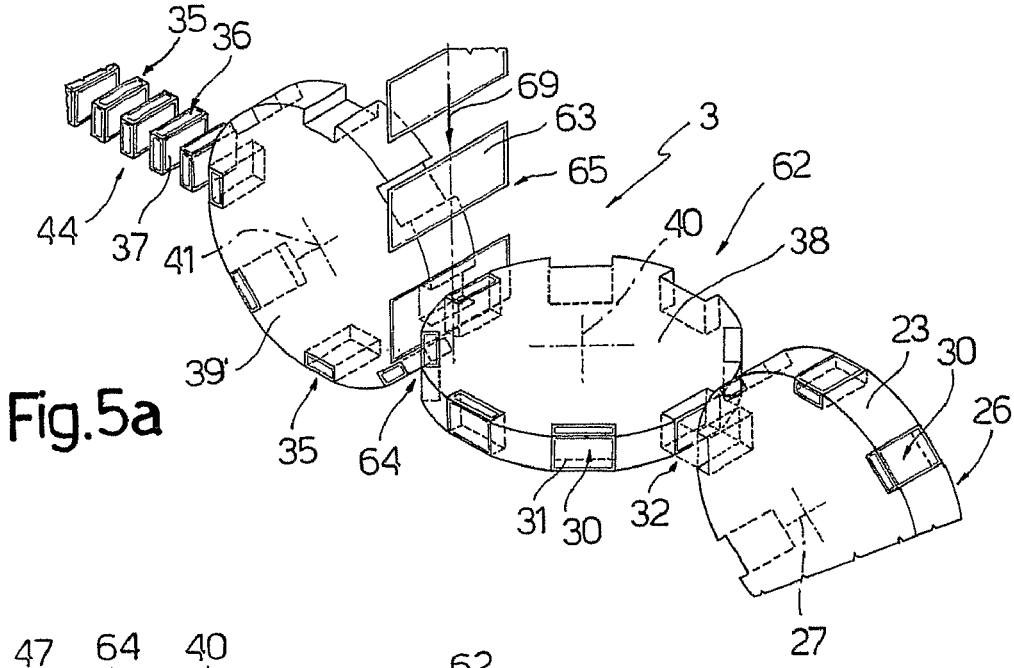

In the FIG. 5*a* embodiment, output portion 3 comprises a packing module 62 similar to packing module 33 and for packing each packet 30 by folding a respective further blank 63 about relative package 31 to form a packet 35 of the type having a double outer package 36 defined by package 31 and by a further outer package 37 made from relative blank 63 and from which packet 30 is at least partly removable. Alternatively, outer package 37 may be at least partly opened for at least partial access to relative packet 30.

Like packing module 33, packing module 62 comprises an input wheel 38 and an output wheel 39', which rotate in steps about respective axes 40 and 41 crosswise to each other and parallel to axes 20 and 27 respectively.

Input wheel 38 is a transfer wheel for receiving packets 30 successively at transfer station 32, and for transferring packets 30 to output wheel 39' at a transfer station 64. On the periphery of input wheel 38, each packet 30 is positioned flat, i.e. with a major lateral surface of relative packed group 13 facing outwards, and with the longitudinal axis of relative packed group 13 (parallel to the relative cigarettes) crosswise to axis 40 and substantially tangent to the outer periphery of input wheel 38.

Output wheel 39' is a packing wheel positioned facing and substantially tangent to the periphery of input wheel 38 at transfer station 64, and for receiving each packet 30 at transfer station 64, together with relative blank 63, which is normally a cardboard blank with preformed fold lines, fed in known manner to transfer station 64 by a feed line 65.

Unlike output wheels 39 of packing modules 33, 46 and 53, each packet 30 is positioned flat on the periphery of output wheel 39', i.e. with a major lateral surface of relative packed group 13 facing outwards, and with the longitudinal axis of relative packed group 13 (parallel to the relative cigarettes) parallel to axis 41 of output wheel 39', which folds each blank 63 in known manner about relative packet 30 to form relative outer package 37, and successively transfers the packets 35 so formed to a drying line 44 defining an output of packing machine 1.

Figure 5B:
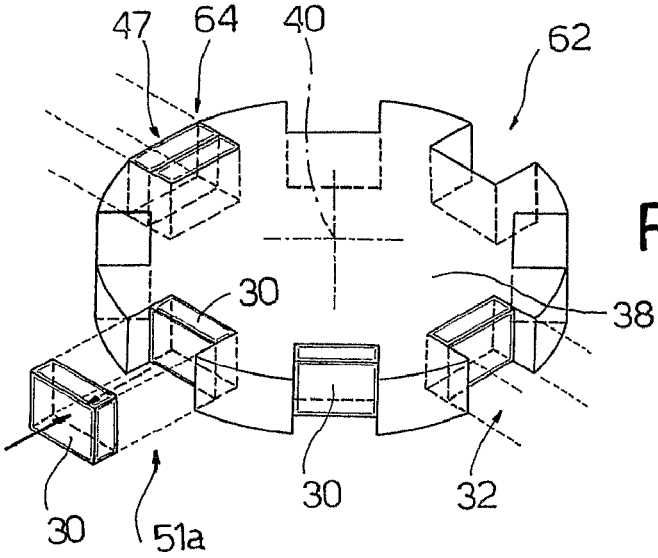
Figure 5C:
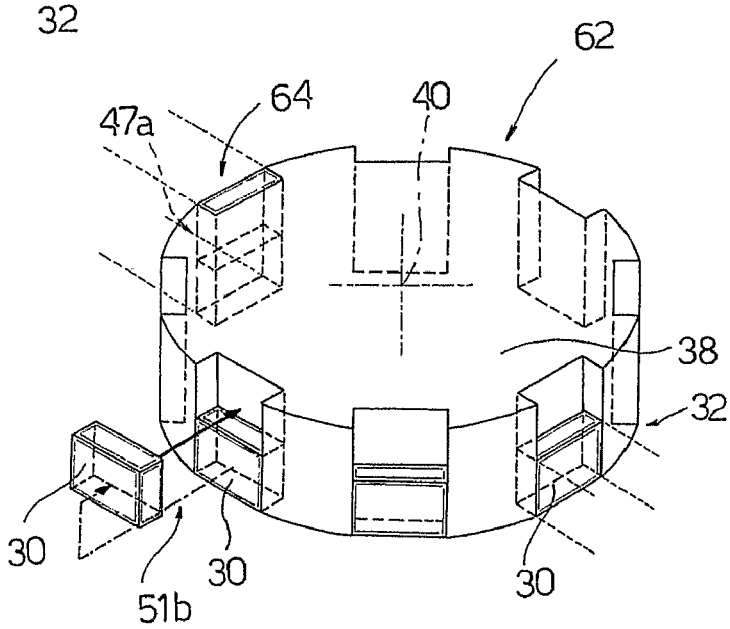

Obviously, in packing module 62 too, transfer station 64 may be defined by an accumulating station similar to accumulating station 51, or, as shown in the variations in FIGS. 5*b* and 5*c*, accumulation may be performed at an accumulation station—indicated 51*a* in FIG. 5*b*, and 51*b* in FIG. 5*c*—located along the periphery of input wheel 38, between transfer stations 32 and 64.

In the case of accumulating station 51*a* (FIG. 5*b*), of every n packets 30 reaching accumulating station 51*a*, n−1 packets 30 are expelled radially and successively from the relative seats on input wheel 38, are accumulated at accumulating station 51*a* in a superimposed position (radially with respect to input wheel 38), and, at the next $n^{th}$ step, are reinserted radially into the next $n^{th}$ seat, superimposed on the packet 30 already inside the next $n^{th}$ seat, to form a group 47. Sequences of n seats are thus formed on input wheel 38, downstream from accumulating station 51*a*, one of which seats houses a group 47, while the others are empty. As with packing module 46 in FIG. 3, the advance rate of input wheel 38 is n times the advance rate of output wheel 39'.

In the case of accumulating station 51*b* (FIG. 5*c*), of every n packets 30 reaching accumulating station 51*b*, n−1 packets 30 are expelled radially and successively from the relative seats on input wheel 38, are moved axially with respect to input wheel 38 so as to be positioned side by side (axially with respect to input wheel 38) inside accumulating station 51*b*, and, at the next $n^{th}$ step, are reinserted radially into the next $n^{th}$ seat, side by side with the packet 30 already inside the next $n^{th}$ seat, to form a group 47*a* of n side by side packets 30. Sequences of n seats are thus formed on input wheel 38, downstream from accumulating station 51*b*, one of which seats houses a group 47*a*, while the others are empty. As with packing module 46 in FIG. 3, the advance rate of input wheel 38 is n times the advance rate of output wheel 39'.

Figure 6:
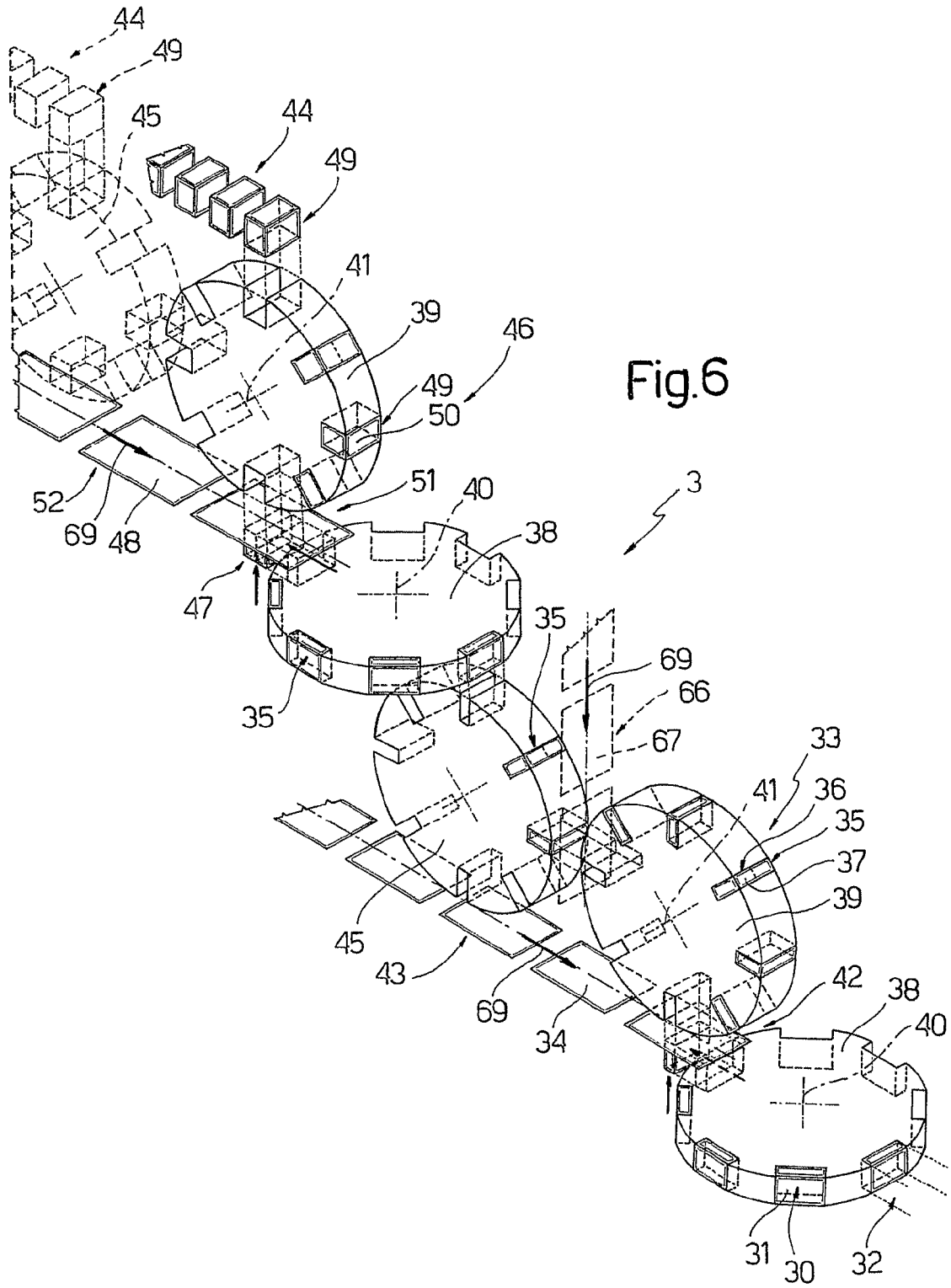

The FIG. 6 embodiment shows, by way of example, how an output portion 3 capable of functioning as a complete packing line can be formed on packing machine 1 by cascade-connecting a number of packing modules of the type shown in FIG. 2 and/or 3 and/or 4 and/or 5.

Output portion 3 in FIG. 6, for example, comprises, in series, a packing module 33 having relative additional wheel 45 and for producing a succession of packets 35, each having a relative outer package 36; and a packing module 46 for forming a succession of groups 47 of packets 35.

Packing module 33 in FIG. 6 employs an auxiliary (dispensable) feed line 66 for feeding a succession of sheets of packing material 67, e.g. sheets of transparent material, to a transfer station between output wheel 39 and additional wheel 45, which, in this case, besides turning over packets 35, also functions as a packing wheel for "cellophaning" packets 35 if required.

Packing module 33 in FIG. 6 may obviously be replaced by any one of packing modules 46, 53, 62.

In packing module 46 in FIG. 6, the advance rate of input wheel 38 is half the advance rate of relative output wheel 39, so as to form a succession of groups 47 of two packets 35 (or two packets 49, or two packets 57). Obviously, the advance rate of input wheel 38 of packing module 46 may be adjusted, so as to be three, four, or five times that of relative output wheel 39, and so permit the formation of a succession of minicartons on output wheel 39 (the seats of which are sized accordingly).

As shown by a comparison of packing module 26 of input portion 2 with any one of packing modules 33, 46, 53, 62, blanks 28 in packing module 26 are fed, as is normally the case on a standard packing machine, to transfer station 24 in a direction 68 parallel to the position assumed by the longitudinal axes of packed groups 13 at transfer station 24, so as to permit formation, about each packed group 13, of a relative package 31, which may be axially opened or axially closed by a lid (to permit axial withdrawal of the cigarettes). In each of packing modules 33, 46, 53, 62, on the other hand, relative blank 34, 48, 56, 63 is fed to transfer station 42 in a direction 69 crosswise to the position assumed by the axes of the cigarettes in packed groups 13 at transfer station 42, so as to permit the formation, if required, about each packet 30 or each group 47 or 55, of a relative outer package 37, 50 or 58, which is laterally open or can be opened to permit at least partial lateral removal of the relative packet/s 30 or simply access to relative packet/s 30.

Figure 7:
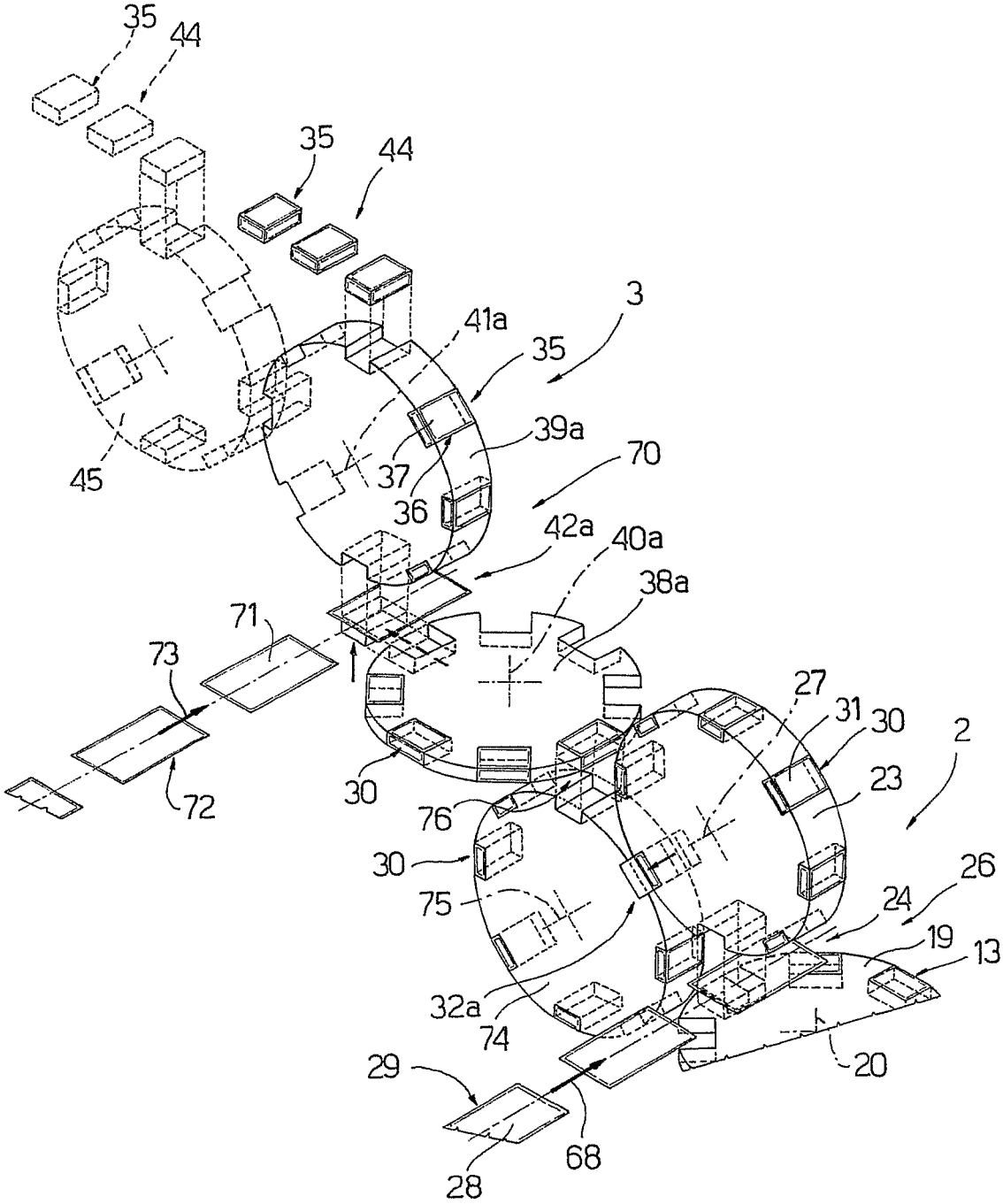

Conversely, and as shown in FIG. 7, it may be necessary to employ, at output portion 3, a packing module 70 identical to packing module 26, i.e. comprising an input wheel 38*a*, on whose periphery each packet 30 is positioned on edge, i.e. with a minor lateral surface of relative packed group 13 facing outwards and parallel to a substantially vertical axis 40*a* of input wheel 38*a*, and with the longitudinal axis of relative packed group 13 (always parallel to the axis of the respective cigarettes) crosswise to axis 40*a* and substantially tangent to the periphery of input wheel 38*a*.

Packing module 70 comprises an output wheel 39*a*, which rotates in steps about an axis 41*a* crosswise to axis 40*a*, and overlaps input wheel 38*a* at a transfer station 42*a*, where packets 30 are unloaded, parallel to axis 40*a*, off input wheel 38*a* onto output wheel 39*a*, on whose periphery each packet 30 is positioned flat, i.e. with a major lateral surface of relative packed group 13 facing outwards, and with the longitudinal axis (always parallel to the relative cigarettes) parallel to axis 41*a* of output wheel 39*a*. As such, a succession of blanks 71 can be fed to transfer station 42*a* by a feed line 72 which, unlike feed lines 43, 52, 61, 65, extends in a direction 73 parallel to direction 68 and to axis 41*a* of output wheel 39*a*.

Packets 30 are transferred from fifth wheel 23 to input wheel 38*a* using an auxiliary input wheel 74, which rotates in steps about an axis 75 parallel to axis 27, is structurally similar to fifth wheel 23, is substantially tangent to fifth wheel 23 at an input transfer station 32*a* of output portion 3, and is located directly beneath the periphery of input wheel 38*a* of packing module 70 at a transfer station 76, where packets 30 are transferred to input wheel 38*a* in a direction substantially radial with respect to axis 75 and parallel to axis 40*a*.

FIGS. 8 and 9 show a symmetrical hinged-lid wallet packet 49, indicated 49*a*, producible on packing machine 1 and comprising two identical packets 30, which have respective packages 31, and are superimposed and housed inside a single hinged-lid outer package 50.

Figure 12:
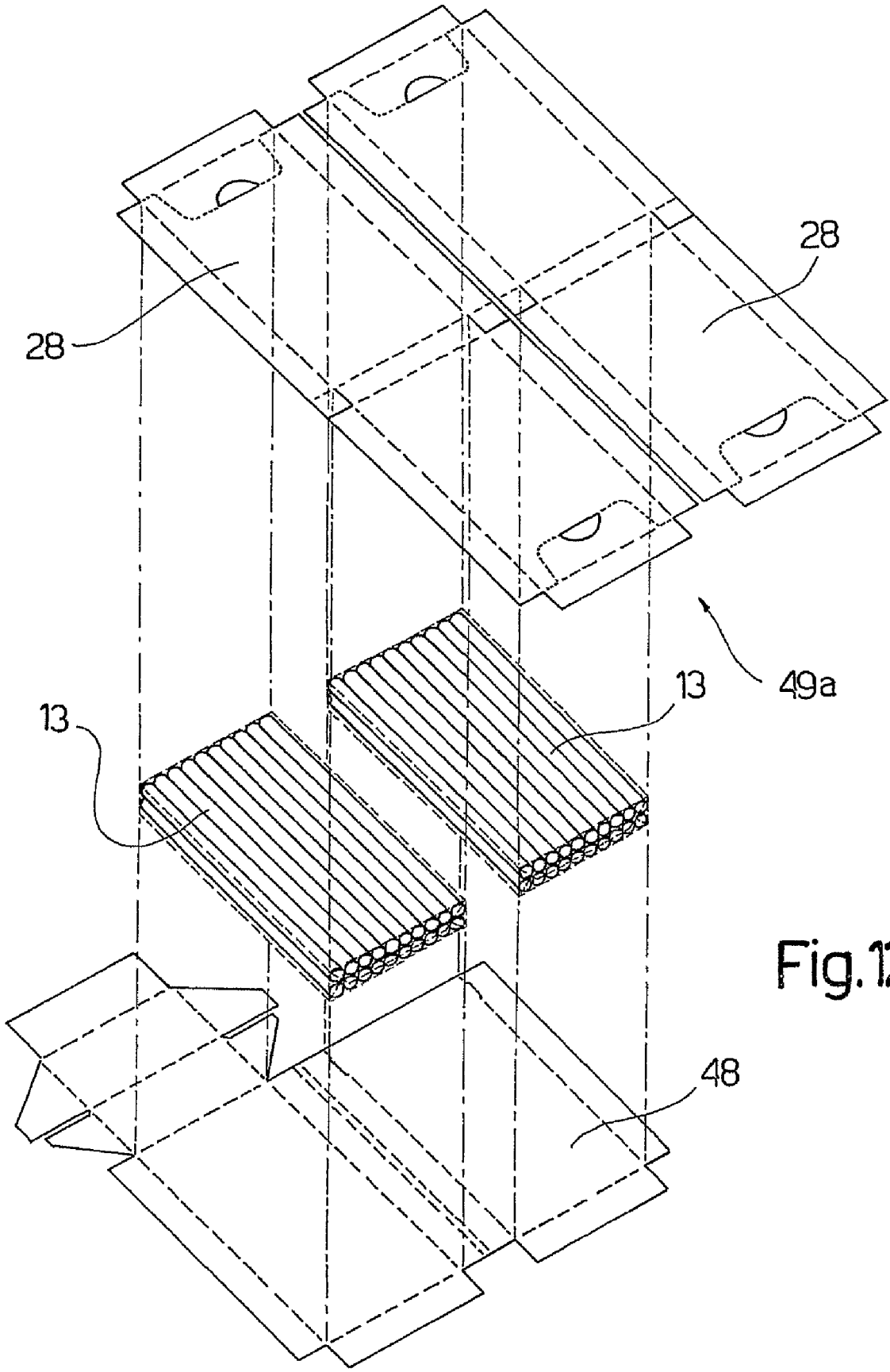
FIGS. 12 and 13 show exploded views of respective embodiments of the FIGS. 8 and 9 packet.

If the internal configuration of packet 49*a* is as shown in FIG. 12, feed line 25 is left idle, and each packed group 13 is combined with a relative blank 28 fed to transfer station 24 by feed line 29 to complete relative packet 30 along fifth wheel 23.

Figure 13:
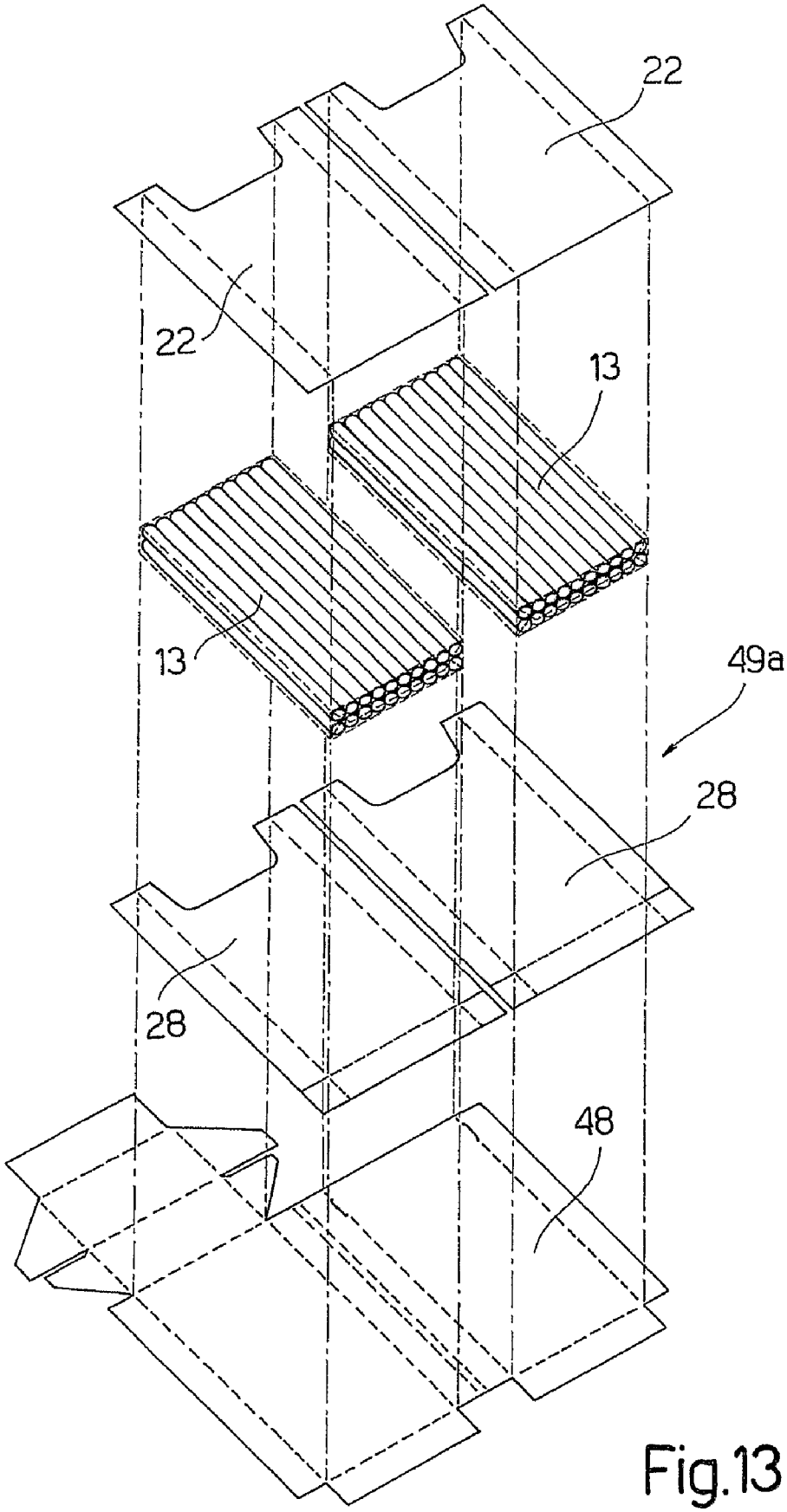

If the internal configuration of packet 49*a* is as shown in FIG. 13, each packed group 13 is first combined with a relative collar 22 fed to fourth wheel 19 by feed line 25, and is then combined with a relative blank 28 fed to transfer station 24 by feed line 29 to complete relative packet 30 along fifth wheel 23.

In both cases, said hinged-lid outer package 50 is formed normally using an output portion 3 comprising packing module 46 (FIG. 3), wherein packets 30 are accumulated in pairs at accumulating station 51, and each pair of packets 30 so formed is packed using a single blank 48 along output wheel 39.

Alternatively, packet 49*a* may be formed using packing module 62 in FIG. 5*a*, wherein transfer station 64 is an accumulating station; or packing module 62 in FIG. 5*b* or 5*c*, wherein packets 30 in each pair are accumulated at accumulating station 51*a*, 51*b*; or packing module 70 (FIG. 7), wherein transfer station 76 is an accumulating station.

Alternatively, packet 49*a* is similar to packet 57, and may be formed using packing module 53 (FIG. 4), wherein one of packets 30 in each pair is formed using packing module 26 (FIG. 1), while the second packet 30 in each pair is fed to input wheel 38 of packing module 53 by feed line 60.

In connection with the above, it should be pointed out that said second packet 30 of each packet 49*a* may be formed using a second input portion 2 (not shown) parallel to input portion 2 in FIG. 1, and connected to packing module 53 at loading station 50. Alternatively, instead of input portion 2 shown, a known input portion (not shown) with two packing lines may be used, wherein groups 5 from a single line 4 are fed alternately to two parallel packing modules 26, one connected to transfer station 32, and the other to loading station 59. The latter two solutions, if compared, for example, with the packing module 46 solution (FIG. 3), have the advantage of enabling input wheel 38 and output wheel 39 to operate at the same advance rate, and at the advance rates of fourth wheels 19 and fifth wheels 23.

FIGS. 10 and 11 show an asymmetrical hinged-lid wallet packet 49, indicated 49*b*, producible on packing machine 1 and comprising two packets 30, indicated 30*a* and 30*b*, which differ in thickness, are superimposed, and are housed inside a single hinged-lid outer package 50.

In this case, one of packets 30*a*, 30*b* may be formed along input portion 2, while the other of packets 30*a*, 30*b* may be produced elsewhere, e.g. by a further input portion 2, and fed directly by feed line 60 (FIG. 4) to output portion 3, which, in this case, comprises packing module 53 (FIG. 4). Obviously, in this case too, instead of input portion 2 in FIG. 1, a known input portion (not shown) with two packing lines may be used, wherein two different types of groups 5, fed in alternate positions by a single line 4, are fed to respective parallel packing modules 26, one connected to transfer station 32, and the other to loading station 59.

Alternatively, input portion 2 may be such as to feed alternate packets 30*a* and 30*b* to transfer station 32; in which case, hinged-lid outer package 50 may be formed using any one of packing modules 46, 62, 70 referred to previously in connection with packet 49*a*.

Figure 14:
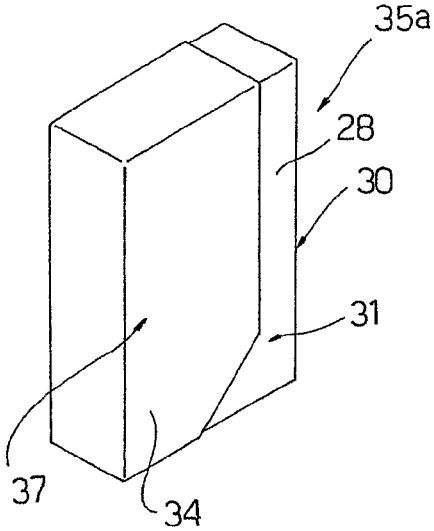
FIGS. 14 and 15 show, in perspective and in a closed and open position respectively, a second type of packet that can be produced on the FIG. 1 packing machine.
Figure 15:
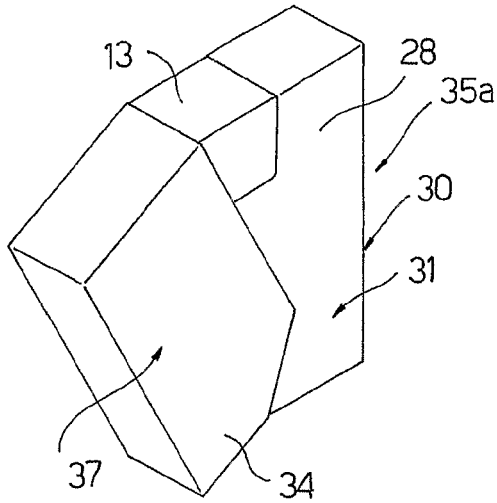

FIGS. 14 and 15 show a "Zippo" packet 35, indicated 35*a*, producible on packing machine 1, and which comprises a packet 30 having a package 31 and housed, in rotary and partly extractable manner, inside a laterally open, cup-shaped, "Zippo" outer package 37.

In this case, feed line 25 is left idle, while each packed group 13 is combined with a relative blank 28, fed to transfer station 24 by feed line 29, to complete relative packet 30 along fifth wheel 23.

The "Zippo" outer package 37 is normally formed using an output portion 3 comprising packing module 33 (FIG. 2), wherein each packet 30 is packed along output wheel 39 using a single blank 34.

Alternatively, packet 35*a* may be formed using packing module 62 in FIG. 5*a*.

Figure 16:
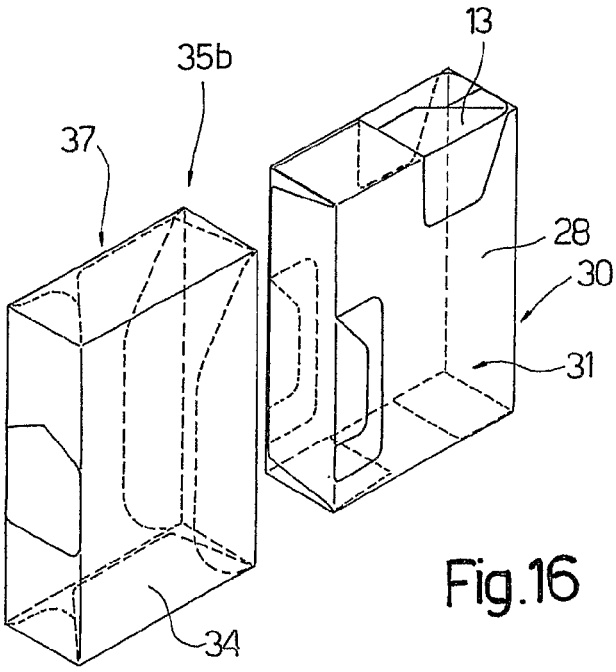
FIG. 16 shows a partly exploded view in perspective of a third type of packet that can be produced on the FIG. 1 packing machine.

FIG. 16 shows a "Slide" type packet 35, indicated 35*b*, producible on packing machine 1, and which comprises a packet 30 having a package 31 and housed, in transversely sliding and partly removable manner, inside a laterally open, cup-shaped, "Slide" type outer package 37.

In this case too, feed line 25 is left idle, while each packed group 13 is combined with a relative blank 28, fed to transfer station 24 by feed line 29, to complete relative packet 30 along fifth wheel 23.

As with packet 35*a*, the "Slide" type outer package 37 is normally formed using an output portion 3 comprising packing module 33 (FIG. 2), wherein each packet 30 is packed along output wheel 39 using a single blank 34.

Alternatively, packet 35*b* may be formed using packing module 62 in FIG. 5*a*.

Figure 17:
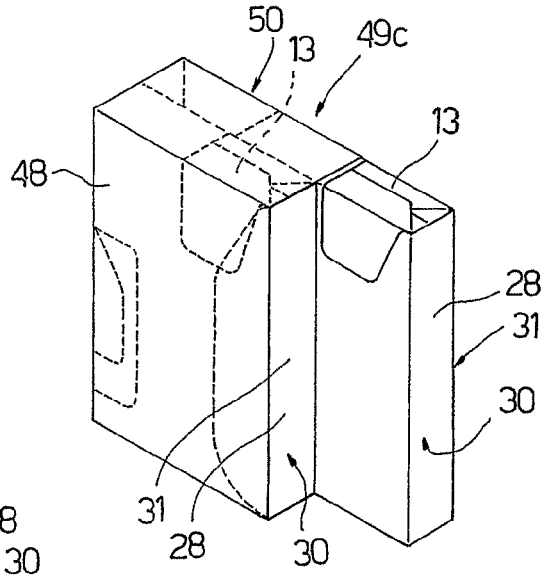
FIG. 17 shows a view in perspective of a variation of the FIG. 16 packet in an open position.

FIG. 17 shows a double "Slide" type packet 49, indicated 35*c*, producible on packing machine 1, and which comprises two side by side packets 30 having respective packages 31 and housed, in transversely sliding and partly removable manner, inside a single laterally open, cup-shaped, "Slide" type outer package 50.

In this case too, feed line 25 is left idle, while each packed group 13 is combined with a relative blank 28, fed to transfer station 24 by feed line 29, to complete relative packet 30 along fifth wheel 23.

As with packet 49*a*, the "Slide" type outer package 50 is normally formed using an output portion 3 comprising packing module 46 (FIG. 3), wherein packets 30 are accumulated in pairs at accumulating station 51, and each pair so formed is packed along output wheel 39 using a single blank 48.

Alternatively, packet 49*c* may be formed using packing module 62 in FIG. 5*a*, wherein transfer station 64 is an accumulating station; or packing module 62 in FIG. 5*b* or 5*c*; or packing module 70 (FIG. 7), wherein transfer station 76 is an accumulating station.

Alternatively, packet 49*c* may be formed using packing module 53 (FIG. 4), wherein one of packets 30 in each pair is formed using packing module 26 (FIG. 1), while the other packet 30 in each pair is fed to input wheel 38 of packing module 53 by feed line 60. In this case too, the packet 30 formation and feed solutions proposed in connection with packet 49*a* may be used.

In a variation (not shown) of packet 49*c*, the two packets 30 differ in thickness.

In this case, one of packets 30 in each pair may be formed along input portion 2, while the other packet 30 in each pair may be produced elsewhere and fed directly by feed line 60 (FIG. 4) to output portion 3, which, in this case, comprises packing module 53 (FIG. 4). In this case too, the packet 30 formation and feed solutions proposed in connection with packet 49*b* may be used.

Alternatively, input portion 2 may be such as to feed packets 30 of different thicknesses alternately to transfer station 32. In which case, the "Slide" type outer package 50 may be formed using any one of packing modules 46, 62, 70 referred to previously in connection with packet 49*c*.

The invention claimed is:

1. A multipurpose packing machine for producing rigid packets of cigarettes and comprising:

an input portion, which comprises at least a first packing module for forming groups of cigarettes, for wrapping sheets of packing material about the groups of cigarettes to form packed groups of cigarettes, and for wrapping at least inner blanks about the packed groups of cigarettes to form a succession of first packages about the packed groups of cigarettes and thus to produce a succession of first packets of cigarettes; and an output portion comprising at least a second packing module similar to the first packing module and for wrapping outer blanks about the first packages to form a succession of second packets of cigarettes, each having a second package housing at least one respective first packet of cigarettes;

wherein in the output portion each outer blank is connected mechanically to the inner blank so that the second package is inseparable from the first packet of cigarettes;

wherein said first and said second packing module each comprise a respective input wheel and a respective output wheel having a first and a second axis respectively;

the input wheel and the output wheel rotating in steps about the respective first and second axis;

and the machine comprising a number of feed lines for respective blanks; the first packing module comprising a first transfer station connecting the respective input wheel to the respective output wheel, and a first said feed line for feeding a succession of first said blanks at least partly defining respective first packages.

2. A machine as claimed in claim 1, wherein, in each said first and second packing module, said first and second axis are crosswise to each other.

3. A machine as claimed in claim 1, wherein, in each of said first and second packing module, the first axis is a vertical axis, and the second axis is a horizontal axis.

4. A machine as claimed in claim 1, wherein the first packing module comprises a second said feed line for feeding a succession of second said blanks, each at least partly defining a respective first package; the second feed line feeding the second blanks between the input wheel and the output wheel of the first packing module, at the first transfer station.

5. A machine as claimed in claim 1, wherein the second packing module comprises a second transfer station connecting the respective input wheel to the respective output wheel, and for transferring said first packets from the input wheel to the output wheel; and a third said feed line for feeding a succession of third said blanks, each at least partly defining a respective second package; the third feed line feeding the third blanks between the input wheel and the output wheel of the second packing module, at the second transfer station.

6. A machine as claimed in claim 5, wherein said second transfer station is a station for successively transferring said first packets and the respective third blanks to the output wheel of the second packing module to form a succession of said second packets, each having a respective second package housing a respective first packet.

7. A machine as claimed in claim 5, wherein said second transfer station is a station for accumulating said first packets into first groups, and for transferring said first groups and the respective third blanks to the output wheel of the second packing module to form a succession of said second packets, each having a respective second package housing a respective first group.

8. A machine as claimed in claim 5, wherein the second packing module comprises, between the first transfer station and the second transfer station, an accumulating station for combining with a first packet, advanced by the input wheel, at least one further first packet previously unloaded off the input wheel at said accumulating station, and for forming a respective first group of first packets.

9. A machine as claimed in claim 5, wherein said second packing module comprises a further feed line connected to the input wheel at a second input station located upstream from the second transfer station; the further feed line supplying the input wheel with a succession of objects, and combining each object, at the second input station, with a respective first packet to form a respective second group; and said second transfer station being a station for successively transferring said second groups and the respective third blanks to the output wheel of the second packing module to form a succession of said second packets, each having a respective second package housing a respective second group.

10. A machine as claimed in claim 9, wherein each said object is a packet similar or identical to the respective first packet.

11. A machine as claimed in claim 5, and comprising at least two said second packing modules in series; each said second packing module comprising a respective third feed line for a respective succession of said third blanks.

12. A machine as claimed in claim 5, wherein the second feed line feeds the second blanks to the first transfer station in a first direction, and the third feed line feeds the respective third blanks to the respective second transfer station in a second direction; said first and said second direction being crosswise to each other.

13. A machine as claimed in claim 12, wherein said first direction is parallel to the second axes, and said second direction is crosswise to the second axes.

14. A machine as claimed in claim 5, wherein the second feed line feeds the second blanks to the first transfer station in a first direction, and the third feed line feeds the respective third blanks to the respective second transfer in a second direction; said first and said second direction being parallel to each other and to the second axes.

15. A machine as claimed in claim 14, wherein, in each packing module, the input wheel has an outer periphery designed to support the respective packed groups positioned on edge and with their respective longitudinal axes substantially tangent to the outer periphery of the input wheel and crosswise to the respective first axis; and the output wheel has an outer periphery designed to support the respective packed groups positioned flat and with their respective longitudinal axes parallel to the respective second axis.

16. A machine as claimed in claim 1, wherein said second packing module comprises an auxiliary output wheel located downstream from the respective output wheel; the auxiliary output wheel being a wheel for turning the second packets over through 180°.

17. A machine as claimed in claim 16, wherein the second packing module comprises a fourth feed line for a succession of fourth blanks; the fourth feed line feeding the fourth blanks between the output wheel and the auxiliary output wheel of the second packing module to pack the second packets.

18. A machine as claimed in claim 1, wherein the input wheel the second packing module has an outer periphery designed to support the respective packed groups positioned flat and with their respective longitudinal axes substantially tangent to the outer periphery and crosswise to the respective first axis.

19. A machine as claimed in claim 18, wherein the output wheel of the second packing module has an outer periphery designed to support the respective packed groups positioned on edge and with their respective longitudinal axes parallel to the respective second axis.

20. A machine as claimed in claim 19, wherein the output wheel of the second packing module has an outer periphery designed to support the respective packed groups positioned flat and with their respective longitudinal axes parallel to the respective second axis.

21. A machine as claimed in claim 1, wherein the first feed line is connected to the input wheel of the first packing module at a first input station located upstream from the first transfer station.

* * * * *